US005565315A

United States Patent [19]

Yamashita

[11] Patent Number: 5,565,315

[45] Date of Patent: Oct. 15, 1996

[54] SILVER HALIDE EMULSION AND PHOTOGRAPHIC MATERIAL USING THE SAME

[75] Inventor: Seiji Yamashita, Kanagawa, Japan

[73] Assignee: Fuji Photo Film Co., Ltd., Kanagawa, Japan

[21] Appl. No.: 517,764

[22] Filed: Aug. 22, 1995

[30] Foreign Application Priority Data

Sep. 9, 1994 [JP] Japan ..... 6-215513

[51] Int. Cl.[6] ..... G03C 1/035; G03C 1/09; G03C 5/17

[52] U.S. Cl. ..... 430/567; 430/570; 430/603; 430/605; 430/966

[58] Field of Search ..... 430/567, 570, 430/603, 605, 966

[56] References Cited

U.S. PATENT DOCUMENTS

| | | | |
|---|---|---|---|
| 5,314,798 | 5/1994 | Brust et al. | 430/567 |
| 5,320,938 | 6/1994 | House et al. | 430/567 |
| 5,413,904 | 5/1995 | Chang et al. | 430/567 |

*Primary Examiner*—Janet C. Baxter
*Assistant Examiner*—Mark F. Huff
*Attorney, Agent, or Firm*—Sughrue, Mion, Zinn, Macpeak & Seas

[57] ABSTRACT

Disclosed is a silver halide emulsion in which at least 50% of the total projected area of silver halide grains comprises tabular core/shell grains each having {100} planes as main planes and said silver halide grain substantially comprises silver chlorobromide with the halogen composition continuously being varied in the shell part.

8 Claims, No Drawings

SILVER HALIDE EMULSION AND PHOTOGRAPHIC MATERIAL USING THE SAME

FIELD OF THE INVENTION

The present invention relates to a photographic material having high sensitivity and excellent rapid processing property and to a silver halide photographic emulsion constituting the photographic material. The excellent rapid processing property as used herein means more specifically that the fixing rate is high and the pressure desensitization/pressure durability at a high-speed transportation is high.

BACKGROUND OF THE INVENTION

A multiple structure grain is described, for example, in JP-A-60-143331, JP-A- 62-196644 and JP-A-61-112142 (the term "JP-A" as used herein means an "unexamined published Japanese patent application"). In particular, JP-A-62-123445 describes a tabular multiple structure grain having an aspect ratio, namely, a ratio of the grain diameter to thickness of 1 or more. However, these patents relate mainly to a silver iodobromide emulsion and do not concern a high silver chloride emulsion which will be described in the present invention. The above-described patents either do not relate to a silver chloride emulsion having a {100} face as a main plane.

These silver iodobromide-type multiple structure grains are highly sensitive and excellent in pressure blackening durability, however, they are low in solubility as compared with silver chloride-type and cannot achieve high sensitivity and rapid processing property at the same time. The accumulation of iodide ions or bromide ions in the developer causes reduction in activity of the developer or inhibition of development. Also, the silver iodobromide emulsion is low in the fixing rate and has no rapid processing property.

There are quite a number of known techniques regarding tabular grains having a high silver chloride content. Examples of the tabular grains having a {111} face as a main plane are described in JP-B-64-8326 (the term "JP-B" as used herein means an "examined Japanese patent publication"), JP-B-64-8325, JP-B-64-8324, JP-A-1-250943, JP-B-3-14328, JP-B-4-81782, JP-B-5-40298, JP-B-5-39459, JP-B-5- 12696, JP-A-63-213836, JP-A-63-218938, JP-A-63-281149 and JP-A- 62-218959.

Known techniques of the tabular grains having a {100} face as a main plane are described in JP-A-5-204073, JP-A-51-88017, JP-A-63-24238, U.S. Pat. No. 5,314,798 (corresponding to JP-A-6-347929 and EP 0534395A1), etc.

However, there is no disclosure on the multilayer-structure high silver chloride grain having a {100} face as a main plane comprising inside of the grain a high Br content layer.

The silver chloride has a crystal habit such that the {100} face is stable more than the {111} face and is suitable for achieving high sensitivity because the {100} face is known to be advantageous in view of dye adsorption or the like. However, if the silver chloride has a uniform structure, it is readily fogged at the chemical sensitization and since the grain has no mechanism therein to accelerate charge separation between the electrons generated at light absorption and the positive holes, inefficiency is present at the time of formation of a latent image.

Further, when the sensitivity is increased, the grain is extremely influenced the effect of pressure fogging. Accordingly, the grain as it is has failed to achieve concomitantly high sensitivity and pressure blackening durability.

Furthermore, if a layer having a maximum Br content is provided as the outermost layer of the grain, the initial fixing rate is retarded and thus, this is not the most preferred selection in achieving rapid fixing or low replenishment system of the fixing solution.

SUMMARY OF THE INVENTION

An object of the present invention is to provide a silver halide photographic emulsion having high sensitivity, low fogging and high covering power (optical density per unit developed silver amount) and a silver halide photographic material containing the emulsion which are excellent in rapid processing property.

Another object of the present invention is to provide a photographic emulsion and a photographic material satisfying the above-described performance and also having excellent pressure blackening durability.

These objects can be achieved by:

(1) a silver halide emulsion in which at least 50% of the total projected area of silver halide grains comprises tabular core/shell grains each having a {100} face as a main plane and the silver halide grain substantially comprises silver chlorobromide with the halogen composition continuously being varied in the shell part;

(2) a silver halide emulsion as described in item (1) above, wherein at least 50% of the total projected area of silver halide grains is occupied by tabular grains having an aspect ratio of 2 or more and a silver chloride content of 20 mol % or more;

(3) a silver halide emulsion as described in items (1) or (2) above, wherein a layer having a highest silver bromide content is provided in the inner region than the final grain growth layer;

(4) a silver halide emulsion as described in items (1) to (3) above, which is subjected to chemical sensitization by a selenium sensitizer and a gold sensitizer;

(5) a silver halide emulsion as described in items (1) to (4) above, which is subjected to spectral sensitization by a dye having an absorption maximum between 530 nm and 570 nm in such a state that the dye is adsorbed to the silver halide grain;

(6) a silver halide photographic material comprising a support having on both side surfaces thereof an emulsion layer containing at least one silver halide emulsion described in items (1) to (5) above;

(7) a silver halide light-sensitive material for radiation as described in item (6) above, which is used in combination with a fluorescent intensifying screen which emits light on exposure to an X ray having an emission peak at 400 nm or less.

The present inventors have made intensive investigations on the realization of a highest fixing rate and highest durability against the fatigue of the fixing solution without changing the total silver bromide content and as a result, they have found that a {100} high silver chloride tabular grain having a structure such that a highest Br content region is present inside the grain exhibits the most excellent performance.

Due to the high Br content region present inside the grain, the positive holes generated on exposure to light are collected there to accelerate the charge separation from electrons, whereby they are prevented to recombine. As a result, the efficiency in forming a latent image can be increased, however, the construction of the present invention exerts a particularly advantageous effect in forming a surface latent image on the {100} tabular grain.

Also, due to the presence of an internal high Br content region, a halogen composition gap and a crystal defect such as dislocation are introduced into the inside of the grain, which are well known in the art to cause pressure desensitization. The present inventors have found that in order to improve the above-described pressure desensitization durability, if a multilayer structure grain comprising a continuous halogen composition structure free of defects in the inside of the grain is formed, the high silver chloride tabular grain having a {100} face as a main plane can have excellent pressure blackening/desensitization durability.

DETAILED DESCRIPTION OF THE INVENTION

The present invention is described in detail below.

The core in the core/shell grain of the present invention means a portion formed on the nucleation at the time of grain formation.

The inside of the core may have various structures such that a discontinuous multiple structure is formed due to heterogenous halogen resulting from the formation of tabular nuclei, crystal defects are introduced accompanying the above-described structure, or when only the core part is taken out, the diffraction pattern determined with an X-ray source having a high decomposition ability and strong monochromaticity has two or more diffraction peaks (on the same diffraction face), however, the internal structure of the core part has little effect on the construction of the present invention.

The term "the halogen composition of the shell part is continuously varied" as used in the present invention means that exclusive of the contribution by the core inside, the grain has a diffraction pattern such that the {200} diffraction line in the X-ray diffraction pattern has substantially only one peak and no trough is present.

Also, the diffraction peak is located between a pure AgBr crystal having an average grain size of 0.5 μm or more and a crystal AgCl crystal, with the half-value width being broader than the half-value width of the pure AgBr and/or the pure AgCl crystal by 10% or more. More specifically, in the X-ray diffraction pattern of the emulsion of the present invention, the diffraction line from the {200} face satisfies the following relation with respect to the peak position and the half-value width.

Relation 1) The peak angle of the silver halide emulsion of the present invention is larger than the peak angle of AgBr but smaller than the peak angle of AgCl.

Relation 2) The half-value width of the silver halide emulsion of the present invention is 1.1 times or more the half of the sum of the half-value width of AgBr and the half-value width of AgCl.

Even if the halogen composition of the shell part is not completely continuous, as long as the above-described relations are satisfied, it falls within the scope of the present invention.

The evaluation of the above-described shell part can be made as follows: only the portion corresponding to the core part is etched by a silver halide solvent or the like, an X-ray diffraction value only of the etched part is obtained, and the value obtained is subtracted from the X-ray diffraction pattern of the entire grain.

In a preferred embodiment of the present invention, the grain as a whole inclusive of the core part satisfies the above-described relations on the X-ray diffraction.

In this case, the core/shell interface has a substantially continuous structure.

The half-value width is more preferably 1.4 times or more, more preferably 1.6 times or more the average of those of AgCl and AgBr.

The substantially silver chlorobromide emulsion of the present invention means an emulsion having a silver chloride content of generally 10 mol % or more, preferably from 20 to 95 mol %, more preferably from 30 to 90 mol %. The silver iodide may not be contained at all or may be contained, inclusive of the core part, in an amount of approximately from 0 to 5 mol %, more preferably from 0 to 2 mol %, of the total silver amount.

The aspect ratio of the silver halide grain of the present invention is a value obtained by dividing the circle-corresponding diameter of a projected area by the thickness of a grain.

With respect to the aspect ratio of the silver halide grain of the present invention, the grains occupying 50% or more of the total projected area have an aspect ratio of 2 or more, preferably from 5 to 100, more preferably from 7 to 20.

The tabular grain of the present invention is a grain having a {100} face as a main plane and accordingly, the projected figure thereof is a right-angled parallelogram. The length ratio of two sides adjacent with each other constituting the right-angled parallelogram is preferably 10 or less, more preferably 2 or less (the lower limit is 1). In the case when the corners of the grain are rounded, the ratio can be obtained from two adjacent sides of a right-angled parallelogram formed by extending sides to circumscribe the grain.

In the right-angled parallelogram in the projected figure of the tabular grain of the present invention, one of four corners is preferably rounded relatively to the other three corners. The rounded part can be determined by the ratio of the area of the defected portion at the corner capable of being rounded to the area of the circumscribed right-angled parallelogram and the term "relatively rounded" as used herein means that the grains having a ratio (average area of the defected portion at the other three corners/area of the circumscribed right-angled parallelogram) of smaller by 50% or more occupies 20% or more, preferably 30% or more, more preferably 50% or more of the total projected area.

The average thickness of the tabular grain occupying 50% of the total projected area of the present invention is preferably 0.3 μm or less, more preferably from 0.05 to 0.2 μm.

The final growth layer referred to in the present invention means the region of from 50 to 500 Å from the grain surface and more specifically, it is a portion exclusive of the portion already grown which corresponds to 90% by volume ratio of the final shape of the grain. A layer having a silver bromide content higher than the average silver bromide content of the final 10% portion which is the above-described final growth part of the multilayer structure grain of the present invention, is preferably present in the remaining shell part.

For example, a construction such that the average silver bromide content of the remaining shell part is higher than that of the final growth layer clearly falls within the scope of the present invention, however, even if the construction is not such, as long as the average silver bromide content of a region having a volume exceeding 10% of the entire in the remaining shell part is higher than the silver bromide content of the final growth layer, it can be said to be an embodiment of the present invention.

The tabular grain of the present invention is described in greater detail below.

The halogen composition of a multilayer structure grain having a continuously varied halogen composition of the present invention may be examined in correspondence with the growing step of the grain and an example thereof include a method where the silver halide is gradually melted from the surface using an etching solution such as a halogen solvent and the halogen composition of the melted part is examined by fluorescent X-ray method or an atomic absorption method. In this case, a highly accurate value can be obtained if an analytical curve is prepared in advance using a standard sample of which halogen composition is known.

Also, the halogen composition may be determined through an analytical electron microscope by analyzing the halogen composition distribution inside the grain into one direction.

The silver bromide content of the surface layer of the silver halide grain according to the present invention can be detected by various surface elemental analysis means. The XPS, Auger electron spectroscopy or ISS method is effectively used. The most simple and highly accurate means is XPS (X-ray Photoelectron Spectroscopy).

The depth capable of analysis by the XPS surface analysis is about 10 Å. Accordingly, the change in the halogen composition in the depth direction can be known by using sputtering in combination.

With respect to the principle of the XPS method for use in the analysis of an iodide content in the vicinity of the surface of a silver halide grain, Junichi Aihara, et al., (*Kyoritsu Library* 16) *Denshi no Bun'ko*, Kyoritsu Shuppan (1978) can be referred to.

A standard XPS method comprises using MgKα as an excitation X ray and observing the strength of photoelectrons (usually, I: $3d_{5/2}$, Ag: $3d_{5/2}$) of iodide (I) and silver (Ag) released from a silver halide grain formed into an appropriate sample body.

The iodide content can be obtained from an analytical curve of a strength ratio (strength (I)/strength (Ag)) of photoelectrons of iodide (I) and silver (Ag), the analytical curve being prepared by using several kinds of standard samples of which iodide content is known. In the case of a silver halide emulsion, the XPS determination must be carried out after decomposing and removing gelatin adsorbed to the silver halide grain surface with a proteolytic enzyme or the like.

The emulsion of the present invention is preferably subjected to selenium sensitization. The selenium sensitization as used herein is carried out by a conventionally known method. More specifically, a labile selenium compound and/or a non-labile selenium compound is added and the emulsion is stirred at a high temperature, preferably 40° C. or higher, for a predetermined time period. The selenium sensitization using a labile selenium sensitizer described in JP-B-44-15748 is preferably used. Specific examples of the labile selenium sensitizer include aliphatic isoselenocyanates such as allylisoselenocyanate, selenoureas, selenoketones, selenoamides, selenocarboxylic acids and esters, and selenophosphates. Particularly preferred labile selenium compounds are set forth below:

I. Colloidal metal selenium

II. Organic selenium compound (selenium atom is double-bonded to the carbon atom of an organic compound by covalent bonding):

a. isoselenocyanates e.g., aliphatic isoselenocyanate such as allylisoselenocyanate b. selenoureas(inclusive of enol form) e.g., aliphatic selenourea such as methyl, ethyl, propyl, isopropyl, butyl, hexyl, octyl, dioctyl, tetramethyl, N-(β-carboxyethyl)-N',N'-dimethyl, N,N-dimethyl, diethyl and dimethyl; aromatic selenourea having one or more aromatic group such as phenyl and tolyl; heterocyclic selenourea having a heterocyclic group such as pyridyl and benzothiazolyl c. selenoketones e.g., selenoacetone, selenoacetophenone, selenoketone with the alkyl group being bonded to >C=Se, selenobenzophenone d. selenoamides e.g., selenoamide e. selenocarboxylic acids and esters e.g., 2-selenopropionic acid, 3-selenolactic acid, methyl-3-selenobutyrate III. Others a. selenides e.g., diethyl selenide, diethyl diselenide, triphenylphosphine selenide b. selenophosphates e.g., tri-p-tolylselenophosphate, tri-n-butylselenophosphate Preferred labile selenium compounds are described above, but these are by no means restrictive. A person skilled in the art generally knows that the labile selenium compound as a sensitizer for a photographic emulsion carries selenium in the organic moiety of the selenium sensitizer molecule and plays no other role than to let the selenium be present in the labile state in the emulsion and that the structure of the compound is not so important as long as the selenium is labile. In the present invention, such a labile selenium compound is advantageously used.

Also, selenium sensitization using non-labile selenium sensitizers described in JP-B-46-4553, JP-B-52-34492 and JP-B-52-34491 may be used. Examples of the non-labile selenium compound include selenious acid, potassium selenocyanide, selenazoles, a quaternary ammonium salt of selenazoles, diaryl selenide, diaryl diselenide, 2-thioselenazolidinedione, 2-selenooxazolidinethione and derivatives of these.

Also, non-labile selenium sensitizers and thioselenazolidinedione compounds described in JP-B-52-38408 are effective. The compounds described in JP-A-4-344635 are particularly preferably used.

The addition amount of the selenium sensitizer used in the present invention varies depending on the activity of the selenium sensitizer used, the kind and the size of silver halide, and the temperature and the time for ripening, however, it is preferably $1\times10^{-8}$ mol or more, more preferably from $1\times10^{-7}$ mol to $1\times10^{-5}$ mol, per mol of silver halide. The temperature in chemical ripening using a selenium sensitizer is preferably 45° C. or higher, more preferably from 50° C. to 80° C. The pAg and the pH can be freely selected. The effect of the present invention can be obtained at a pH over a wide range, for example, of from 4 to 9.

The chemical sensitization is more effective when it is done in the presence of a silver halide solvent.

Examples of the silver halide solvent which can be used in the present invention include (a) organic thioethers described in U.S. Pat. Nos. 3,271,157, 3,531,289 and 3,574,628, JP-A-54-1019 and JP-A-54-158917, (b) thiourea derivatives described in JP-A-53-82408, JP-A-55-77737 and JP-A-55-2982, (c) silver halide solvents having a thiocarbonyl group interposed between the oxygen or sulfur atom and the nitrogen atom described in JP-A-53-144319, (d) imidazoles described in JP-A-54-100717, (e) sulfites and (f) thiocyanates.

Particularly preferred solvents are thiocyanate and tetramethylthiourea. The amount of the solvent used varies depending on the kind thereof, however, for example, in the case of a thiocyanate, it is preferably from $1\times10^{-4}$ mol to $1\times10^{-2}$ mol per mol of silver halide.

The silver halide photographic emulsion of the present invention can achieve further higher sensitivity and lower fogging by using gold sensitization in combination in the chemical sensitization. If desired, sulfur sensitization is also preferably used in combination.

The sulfur sensitization is usually carried out by adding a sulfur sensitizer and stirring the emulsion at a high temperature, preferably 40° C. or higher, for a predetermined time period.

The gold sensitization is usually carried out by adding a gold sensitizer and stirring the emulsion at a high temperature, preferably 40° C. or higher, for a predetermined time period.

A known sulfur sensitizer may be used in the above-described sulfur sensitization. Examples of the known sulfur sensitizer include thiosulfate, allylthiocarbamidethiourea, allylisocyanate, cystine, p-toluenethiosulfonate and rhodanine. In addition, sulfur sensitizers described in U.S. Pat. Nos. 1,574,944, 2,410,689, 2,278,947, 2,728,668, 3,501,313 and 3,656,955, German Patent 1,422,869, JP-B-56-24937 and JP-A- 55-45019 may also be used. The sulfur sensitizer may serve satisfactorily if it is used in an amount large enough to effectively increase the sensitivity of the emulsion. The addition amount varies over a rather wide range under various conditions such as the pH, the temperature, the size of silver halide grain, but it is preferably from $1\times10^{-7}$ to $5\times10^{-5}$ mol per mol of silver halide.

The gold sensitizer used for the above-described gold sensitization may have a gold oxidation number either of +1 valence or +3 valence and a gold compound usually used as a gold sensitizer may be used. Representative examples thereof include chloroaurate, potassium chloroaurate, auric trichloride, potassium auric thiocyanate, potassium iodoaurate, tetracyanoauric acid, ammonium aurothiocyanate and pyridyltrichlorogold.

The addition amount of the gold sensitizer may vary depending upon various conditions but, as a standard, it is preferably from $1\times10^{-7}$ mol to $5\times10^{-5}$ mol per mol of silver halide.

In the chemical ripening, the addition time and the addition order of a silver halide solvent and a gold sensitizer used in combination with a selenium sensitizer, a sulfur sensitizer or a tellurium sensitizer need not be particularly restricted and for example, the above-described compounds may be added simultaneously (preferably) at the initial stage of the chemical ripening or during the proceeding of the chemical ripening or they may be added separately at different times. The above-described compounds each may be added after dissolving it in water or an organic solvent capable of mixing with water, for example, a single solution or a mixed solution of methanol, ethanol and acetone.

In the present invention, noble metal sensitization is preferably used in combination.

In the noble metal sensitization, a noble metal salt such as gold, platinum, palladium or iridium may be used and among these, gold sensitization and palladium sensitization are both preferably used in combination. In the gold sensitization, a known compound such as chloroaurate, potassium chloroaurate, potassium aurithiocyanate, gold sulfide or a gold selenide may be used. The palladium compound means a palladium divalent salt or quatervalent salt. The preferred palladium compound is represented by $R_2PdX_6$ or $R_2PdX_4$, wherein R represents a hydrogen atom, an alkali metal atom or an ammonium group and X represents a halogen atom such as a chlorine, bromine or iodine atom. Specific preferred examples thereof include $K_2PdCl_4$, $(NH_4)_2PdCl_4$, $Na_2PdCl_4$, $(NH_4)_2PdCl_4$, $Li_2PdCl_4$, $Na_2PdCl_6$ and $K_2PdBr_4$. The gold compound and the palladium compound each is preferably used in combination with a thiocyanate or a selenocyanate.

The silver halide emulsion of the present invention is preferably subjected to reduction sensitization during the grain formation, before chemical sensitization or during chemical sensitization but after the grain formation, or after chemical sensitization.

The reduction sensitization may be carried out by any one of a method where a reduction sensitizer is added to a silver halide emulsion, a method where the emulsion is grown or ripened in a low pAg atmosphere at a pAg of from 1 to 7 called silver ripening and a method where the emulsion is grown or ripened at a high pH atmosphere at a pH of from 8 to 11 called high pH ripening. Two or more of these methods may be used in combination.

Examples of known reduction sensitizers include stannous salt, ascorbic acid and a derivative thereof, amine and polyamines, a hydrazine derivative, formamidinesulfinic acid, silane compound and a borane compound. In the reduction sensitization of the present invention, a compound selected from these known reduction sensitizers may be used. Two or more compounds may also be used in combination. Preferred compounds as a reduction sensitizer are stannous salt, thiourea dioxide, dimethylamineborane and ascorbic acid and a derivative thereof. The addition amount of the reduction sensitizer depends on the conditions in producing an emulsion and thus, the addition amount must be appropriately selected according to the case, but it is preferably from $10^{-7}$ to $10^{-3}$ mol per mol of silver halide.

During production of an emulsion of the present invention, an oxidizing agent for silver is preferably used. The oxidizing agent for silver means a compound capable of acting on metal silver to convert it into a silver ion. In particular, a compound which converts very fine silver grains by-produced during the formation or the chemical sensitization of a silver halide grain into silver ions is useful. The silver ion produced here may form a sparingly water-soluble silver salt such as silver halide, silver sulfide or silver selenide or readily water-soluble silver salt such as silver nitrate. The oxidizing agent for silver may be either an inorganic material or an organic material. Examples of the inorganic oxidizing agent include an oxygen acid salt such as ozone, hydrogen peroxide and an addition product thereof (e.g., $NaBO_2.H_2O_2$, $3H_2O$, $2NaCO_3.3H_2O_2$, $Na_4P_2O_7.2H_2O_2$, $2Na_2SO_4.H_2O_2.2H_2O$), peroxy acid salt (e.g., $K_2S_2O_8$, $K_2C_2O_6$, $K_2P_2O_8$), peroxy complex compound (e.g., $K_2[Ti(O_2)C_2O_4].3H_2O$, $4K_2SO_4.Ti(O_2)OH.SO_4.2H_2O$, $Na_3[VO(O_2)(C_2H_4)_2]6H_2O$), permanganate (e.g., $KMnO_4$) and chromate (e.g., $K_2Cr_2O_7$); a halogen element such as iodine and bromine; a perhalogen acid salt (e.g., potassium periodate); a salt of high valency metal (e.g., potassium hexacyanoferrate(III)); and a thiosulfonate.

Examples of the organic oxidizing agent include a quinone such as p-quinone, an organic peroxide such as peracetic acid and perbenzoic acid, and a compound which releases an active halogen (e.g., N-bromosuccinimide, chloramine T, chloramine B).

Preferred examples of the oxidizing agent of the present invention include an inorganic oxidizing agent such as ozone, hydrogen peroxide and an addition product thereof, halogen element and thiosulfonate; and an organic oxidizing agent such as a quinone. In a preferred embodiment, the above-described reduction sensitization and an oxidizing agent for silver are used in combination. The combination use method thereof may be selected from a method where an oxidizing agent is used and then, reduction sensitization is applied, a method reverse thereto and a method where they are concomitantly used. These methods may be carried out either in the grain formation step or in the chemical sensitization step.

The photographic emulsion for use in the present invention may contain various compounds so as to prevent fogging or to stabilize photographic performance, during preparation, storage or photographic processing of a photographic material. Specifically, a large number of compounds known as an antifoggant or a stabilizer may be added and examples thereof include thiazoles such as benzothiazolium salts, nitroimidazoles, nitrobenzimidazoles, chlorobenzimidazoles, bromobenzimidazoles, mercaptothiazoles, mercaptobenzthiazoles, mercaptobenzimidazoles, mercaptothiadiazoles, aminotriazoles, benzotriazoles, nitrobenzotriazoles and mercaptotetrazoles (in particular, 1-phenyl- 5-mercaptotetrazoles); mercaptopyrimidines; mercaptotriazines; thioketo compounds, e.g., oxazolinethione; and azaindenes, e.g., triazaindenes, tetrazaindenes (in particular, 4-hydroxy-substituted (1,3,3a,7)tetrazaindene) and pentazaindenes. For example, those described in U.S. Pat. Nos. 3,954,474 and 3,982,947 and JP-B-52-28660 may be used. One of preferred compounds includes the compounds described in JP-A-63-212932. The antifoggant and the stabilizer may be added at any stage according to the purpose, such as before grain formation, during grain formation, after grain formation, at the water washing step, at the dispersion after water washing, before chemical sensitization, during chemical sensitization, after chemical sensitization or before coating.

In the emulsion according to the present invention, various additives as described above may be used but also, other various additives may be used depending upon the purpose.

These additives are described in more detail in *Research Disclosure*, Item 17643 (December, 1978), ibid., Item 18716 (November, 1979) and ibid., Item 308119 (December, 1989).

The photographic material of the present invention may use the emulsion of the present invention alone as an emulsion for use in one emulsion layer or may use two or more kinds of emulsions in combination in the same layer where the light-sensitive silver halide emulsions are different at least in one property such as the grain size, the grain size distribution, the halogen composition, the grain form, or the sensitivity thereof.

In the photographic material of the present invention, an emulsion layer containing at least one silver halide emulsion of the present invention is preferably provided on both side surfaces of a support.

The silver coated amount of the photographic material is preferably 5.0 g/m$^2$ or less, most preferably 4.0 g/m$^2$ or less on the surface provided with the emulsion layer.

As the sensitizing dye for use in the present invention, one or more sensitizing dye selected from the sensitizing dyes represented by the following formulae (I) and (II) can be used.

At least one of the dyes used preferably has a spectral sensitivity peak of from 530 to 570 nm.

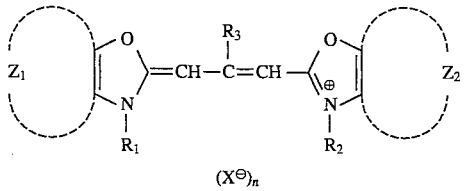

wherein $R_1$ and $R_2$ each represents a substituted or unsubstituted alkyl group, a substituted or unsubstituted alkenyl group, a substituted or unsubstituted aryl group and at least one of $R_1$ and $R_2$ is a sulfoalkyl group or a carboxyalkyl group; $R_3$ represents an alkyl group; $X^-$ represents a counter ion necessary for neutralizing the charge of the molecule; n represents a number necessary for the neutralization, provided that when an inner salt is formed n is 1; and $Z_1$ and $Z_2$ each represents a nonmetallic atom group necessary for forming a benzene ring or naphtho ring which may have a substituent.

The compound represented by formula (I) is described in more detail.

$R_1$ and $R_2$, which may be the same or different, each represents an alkyl group having from 1 to 4 carbon atoms such as a methyl group, an ethyl group, a propyl group or a butyl group, a substituted alkyl group having from 1 to 4 carbon atoms substituted, for example, by a halogen atom or a hydroxy group or an alkenyl group having carbon atoms up to 4 such as an allyl group or a 2-butenyl group.

Either of $R_1$ or $R_2$ is a sulfoalkyl group having from 2 to 4 carbon atoms such as a 2-sulfoethyl group, a 3-sulfopropyl group, a 3-sulfobutyl group, a 4-sulfobutyl group, a 2-(3-sulfopropoxy)ethyl group, a 2-hydroxy-3-sulfopropyl group or a 3-sulfopropoxyethoxyethyl group, or a carboxyalkyl group such as a 2-carboxyethyl group, a 3-carboxypropyl group, a 4-carboxybutyl group or a carboxymethyl group.

$R_3$ represents an alkyl group having from 1 to 2 carbon atoms such as a methyl group or an ethyl group.

$X^-$ represents an anion such as a halogen atom (e.g., I, Br, Cl).

$Z_1$ and $Z_2$ each represents a nonmetallic-atom group necessary for forming a benzene ring or a naphthalene ring which may have a substituent in the condensed ring and the ring may be substituted by a substitutable group such as a halogen atom, a cyano group, an alkyl group, an alkoxy group, an aryl group, a trifluoromethyl group, an alkoxycarbonyl group or an acyl group.

n represents 1 or 2 and when the dye forms an inner salt, n is 1.

When $R_1$ or $R_2$ is a sulfoalkyl group or a carboxyalkyl group, it may form a salt in the form of an R—$SO_3M$ group or an R—COOM group, wherein M represents a hydrogen atom, an alkali metal atom (e.g., Na, K) or an ammonium group.

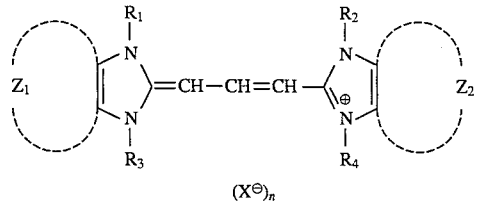

wherein $R_1$, $R_2$, $R_3$ and $R_4$ each represents a substituted or unsubstituted alkyl group; $X^-$ represents an ion necessary for neutralizing the charge of the molecule; n represents a number necessary for the neutralization and when an inner salt is formed, n is 0; $Z_1$ and $Z_2$ each represents a nonmetallic atom group necessary for forming a benzene ring or a naphtho ring, which may have a substituent.

The compound represented by formula (II) is described in more detail.

$R_1$, $R_2$, $R_3$ and $R_4$ each represents an alkyl group having from 1 to 4 carbon atoms such as a methyl group, an ethyl group, a propyl group or a butyl group, or a substituted alkyl group such as hydroalkyl, alkoxyalkyl, halogen, alkoxycarbonylalkyl, acyloxyalkyl, carboxyalkyl or sulfoalkyl. The sulfoalkyl group and the carboxyalkyl group each may form a salt of R—$SO_2M$ or R—COOM.

$Z_1$ and $Z_2$ each represents a nonmetallic atom group necessary for forming a benzene ring or a naphthalene ring which may have a substituent in the condensed ring and the examples of substituent group include a halogen atom such as Cl, Br or fluoro group, a trifluoromethyl group, a R—COOM group (wherein R represents a hydrogen atom or an alkyl group having from 1 to 5 carbon atoms such as a methyl group, an ethyl group, a propyl group, a butyl group or a pentyl group, or an aryl group such as a phenyl group), or a cyano group.

X and n each has the same meaning as in formula (I).

The addition of a sensitizing dye may be carried out during the production of the emulsion of the present invention by any of various known methods. For example, as described in U.S. Pat. No. 3,469,987, a sensitizing dye is dissolved in a volatile organic solvent, the resulting solution is dispersed in a hydrophilic colloid and the dispersion is added to the emulsion. Further, the sensitizing dyes of the present invention may be individually dissolved in the same or different solvents and the solutions may be mixed before the addition thereof to the emulsion or may be added separately.

In adding the sensitizing dye to the silver halide emulsion in the present invention, a water miscible organic solvent such as methyl alcohol, ethyl alcohol or acetone is preferably used as the solvent for the dye.

The addition amount of the sensitizing dye to the silver halide emulsion is in the present invention preferably from $1\times10^{-5}$ to $2.5\times10^{-2}$ mol, more preferably from $1.0\times10^{-5}$ to $1.0\times10^{-2}$ mol, per mol of silver halide.

The mixing of two or more dyes may be carried out at any mixing ratio according to the purpose.

Also, the sensitizing dye may be used in combination with other sensitizing dye or a supersensitizing dye.

A dye which has no spectral sensitization effect by itself or a substance which absorbs substantially no visible light, but which shows supersensitization may be added to the emulsion together with the sensitizing dye.

For example, the dyes described in JP-A-5-61148 are preferably used.

Examples of preferred spectral sensitizing dyes for use in the present invention are described below.

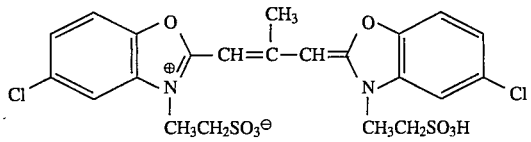
I-1

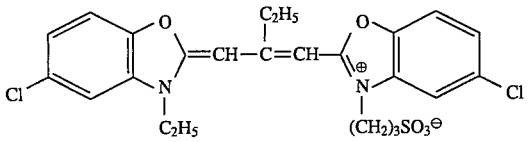
I-2

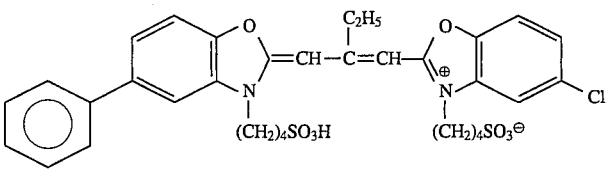
I-3

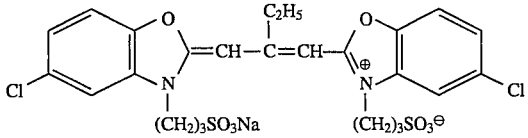
I-4

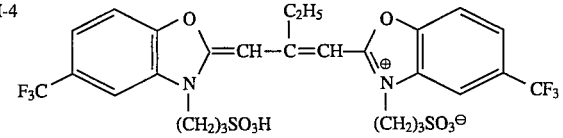
I-5

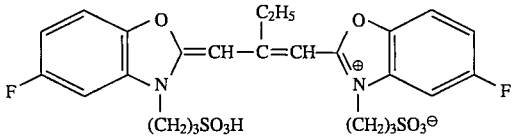
I-6

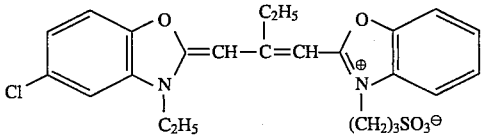
I-7

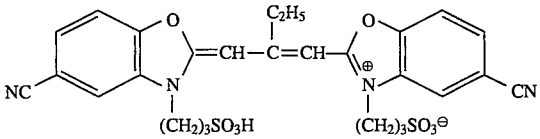
I-8

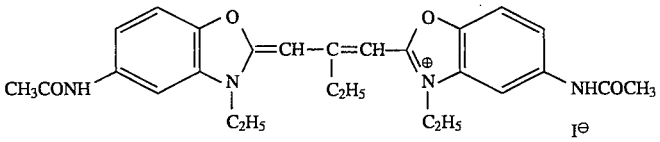
I-9

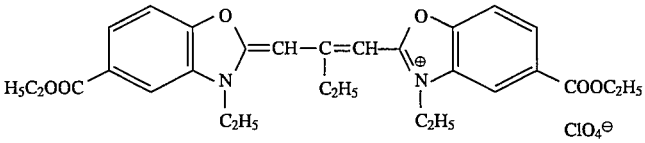
I-10

-continued
I-11
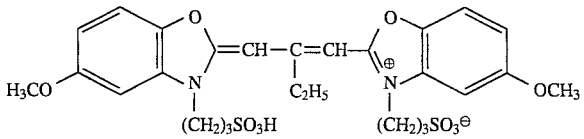
I-12
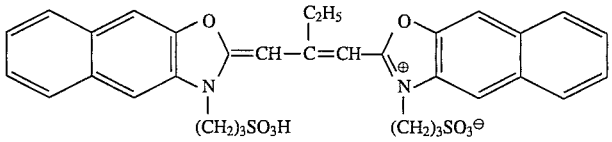
II-1
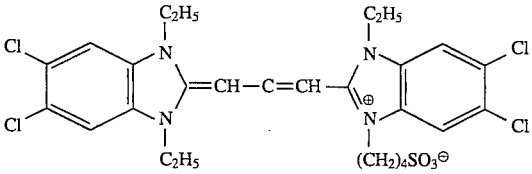
II-2
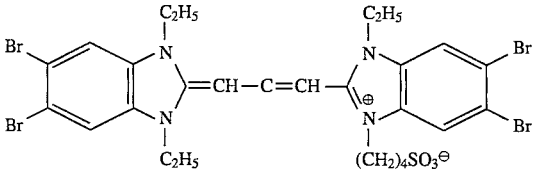
II-3
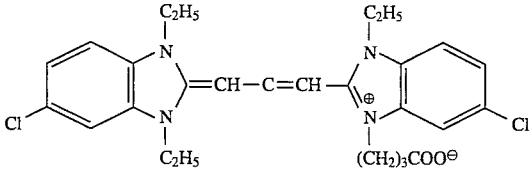
II-4
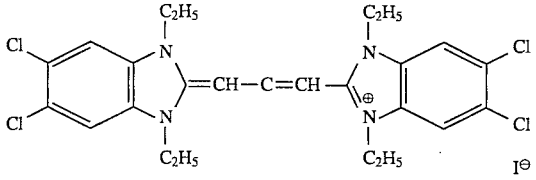
II-5
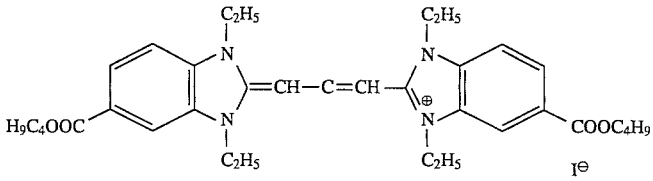
II-6
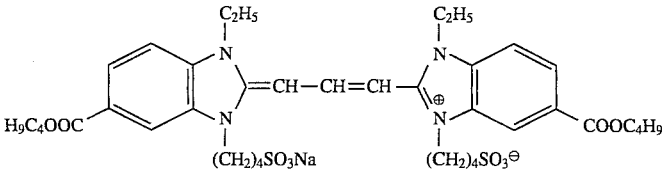
II-7
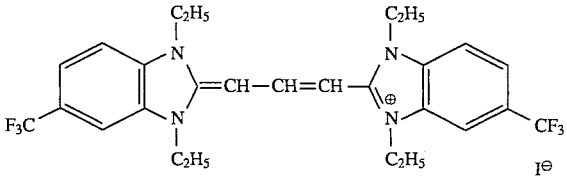
II-8
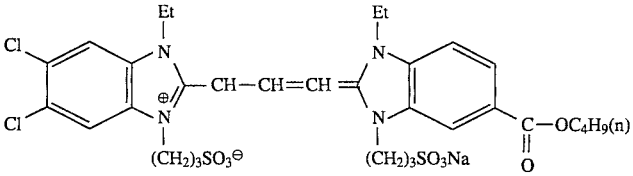
II-9
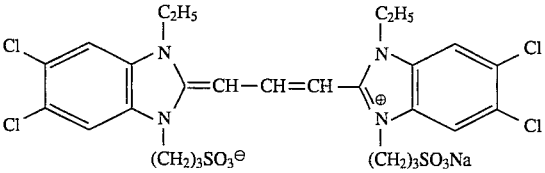
II-10
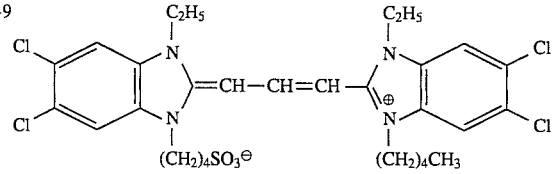

-continued

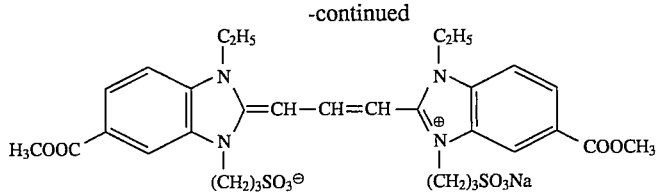

II-11

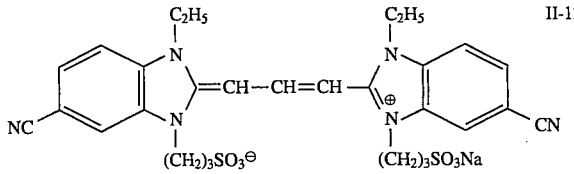

II-12

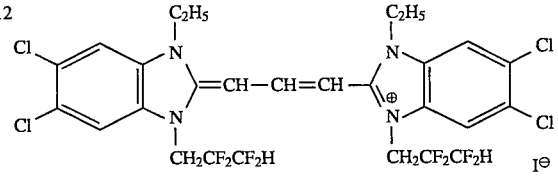

II-13

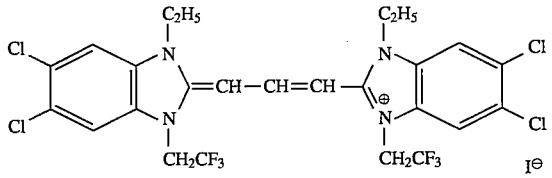

II-14

The photographic material of the present invention may be preferably used in X-ray photographing using the following fluorescent material as a fluorescent intensifying screen.

Blue Emission Fluorescent Material $Y_2O_2S$:Tb, LaOBr:Tb, BaFCl:Eu

Green Emission Fluorescent Material $Gd_2O_2S$:Tb, $LaO_2S$:Tb

UV Emission Fluorescent Material titanium-free hafnium zirconium germanate phosphor described in JP-A-6-11804, $YTaO_4$, $YTaO_4$:Nb The photographic material of the present invention is particularly preferably used in combination with a UV emission fluorescent material screen.

In the present invention, a known mercury compound may be used. Examples thereof include mercurous salts and mercuric salts described in U.S. Pat. No. 2,728,664, mercury oxides described in U.S. Pat. No. 3,615,620 and complex compounds such as a molecular compound of a mercuric salt with an organic compound containing a basic nitrogen atom described in British Patents 742,219 and 742,222 and U.S. Pat. Nos. 2,728,663 and 2,728,666.

The preferred mercury salt may be either an inorganic salt or an organic salt and examples thereof include mercurous or mercuric acetate; mercurous formate; mercurous or mercuric oxalate;a mixed halide (for example, a chloride, a bromide, a fluoride or an iodide) such as mercuric bromoiodide and mercuric bromochloride; mercurous or mercuric nitrate; and mercurous or mercuric sulfate. In view of solubility, a mercury salt of acetic acid and a mercury salt of hydrohalogenic acid are preferred.

In the case when an oxide compound is used, the mercuric oxide is preferred because it has a solubility larger than that of the mercurous oxide.

The mercury compound for use in the present invention can be added at any stage during the production of a photographic material. More specifically, the mercury compound may be added to a silver halide emulsion during the production of the silver halide emulsion or may be added to the emulsion immediately before coating the emulsion on a support. The mercury compound is preferably added during the production of a silver halide emulsion, more preferably before the completion of chemical sensitization, still more preferably before the initiation of desilvering. The layer to which the mercury compound is added may be a silver halide emulsion layer or a hydrophilic colloid layer adjacent to the silver halide emulsion layer and it is preferably a silver halide emulsion layer.

The addition amount of the mercury compound for use in the present invention is preferably from $10^{-9}$ to $10^{-2}$ mol, more preferably $10^{-8}$ to $10^{-4}$ mol, per mol of silver.

There is no particular limitation on various additives used for the photographic materials of the present invention. For example, additives described in the corresponding portions of JP-A-2-68539 shown below can be used.

| | Item | Corresponding Portion |
|---|---|---|
| 1. | Silver Halide Emulsions and Preparation Thereof | JP-A-2-68539, page 8, lower right column, line 6 from the bottom to page 10, upper right column, line 12 |
| 2. | Chemical Sensitization | page 10, upper right column, line 13 to lower left column, line 16 |
| 3. | Antifoggants and Stabilizers | page 10, lower left column, line 17 to page 11, upper left column, line 7; page 3, lower left column, line 2 to page 4, lower left column |
| 4. | Spectral Sensitizing Dye | page 4, lower right column, line 4 to page 8, lower right column |
| 5. | Surfactants and Anti-static Agents | page 11, upper left column, line 14 to page 12, upper left column, line 9 |
| 6. | Matting Agents, Lubricants and Plasticizers | page 12, upper left column, line 10 to upper right column, line 10 |
| 7. | Hydrophilic Colloids | page 12, upper right column, line 11 to lower left column, line 16 |
| 8. | Hardeners | page 12, lower left column, line 17 to page 13, upper right column, line 6 |
| 9. | Supports | page 13, upper right column, line 7 to line 20 |
| 10. | Dyes and Mordants | page 13, lower left column, line 1 to page 14, lower left column, line 9 |

Preferred examples of the methods for forming images using the photographic materials of the present invention include a method for forming images in combination with a fluorescent material having a main peak preferably at 400 nm or less (i.e., the fluorescent material which is subjected to emission in the neighborhood of the peak by irradiation of X-ray), and more preferably a method for forming images in combination with a fluorescent material having a main peak in the region of 380 nm or less.

As the screens each having a main peak of emission at 400 nm or less, screens described in JP-A-6-11804 and WO93/01521 can be used, but the present invention is not limited to these screens.

The photographic materials of the present invention can be preferably subjected to development-processing with a developing solution containing an ascorbic acid and derivatives thereof as a developing agent.

The replenishment rate of the processing solutions is preferably 10 ml/25.4 cm×30.5 cm or less, and more preferably 5 ml/25.4 cm×30.5 cm or less, thereby exhibiting the effect markedly.

As ascorbic acid and its derivatives used in the developing solutions in the present invention, compounds represented by formula (I) described in JP-A-5-165161 and Compounds I-1 to I-8 and II-9 to II-12 described therein are particularly preferred.

The ascorbic acid compounds used in the developing solutions in the present invention are generally known as compounds of the endiol type, the enaminol type, the endiamine type, the thiol-enol type and the enamine-thiol type. Examples of these compounds are described in U.S. Pat. No. 2,688,549, JP-A-62-237443, etc. Methods for synthesizing these ascorbic acid compounds are also well known, and described in, for example, Tuguo Nomura and Hirohisa Ohmura, *Chemistry of Reductone*, Uchida Rokakuho Shinsha, 1969.

The ascorbic acid compounds used in the present invention can be used also in the form of alkali metal salts such as lithium salts, sodium salts or potassium salts. These ascorbic acid compounds are preferably used in an amount of 1 to 100 g per liter of developing solution, and more preferably in an amount of 5 to 80 g per liter of developing solution.

In the present invention, particularly, 1-phenyl-3-pyrazolidones or p-aminophenols are preferably used together with the ascorbic acid compounds.

Examples of the 3-pyrazolidone-based developing agents used in the present invention include 1-phenyl-3pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl- 3-pyrazolidone, 1-phenyl-5-methyl-3-pyrazolidone, 1-p-aminophenyl-4,4-dimethyl-3-pyrazolidone, 1-p-tolyl- 4,4-dimethyl-3-pyrazolidone and 1-p-tolyl-4-hydroxymethyl- 3-pyrazolidone.

Examples of the p-aminophenol-based developing agents used in the present invention include N-methyl-p-aminophenol, p-aminophenyl, N-(β-hydroxyethyl)-p-aminophenol, N-(4-hydroxyphenyl)glycine, 2-methyl-p-aminophenol and p-benzylaminophenol, and among them, N-methyl-p-aminophenol is preferred.

In general, the developing agents are preferably used in an amount of 0.001 to 1.2 mol/liter.

Alkali agents used for pH adjustment include pH adjustors such as sodium hydroxide, potassium hydroxide, sodium carbonate, potassium carbonate, sodium tertiary phosphate and potassium tertiary phosphate.

Examples of sulfites used as preservatives for the developing solutions of the present invention include sodium sulfite, potassium sulfite, lithium sulfite, ammonium sulfite, sodium bisulfite and potassium metabisulfite. The amount of sulfites to be used is preferably 0.01 mol/liter or more, and more preferably 0.02 mol or more. The upper limit is preferably 2.5 mol/liter.

Besides these, preservatives described in L. F. A. Maison, *Photographic Processing Chemistry*, Focal Press, pp 226–229 (1966), U.S. Pat. Nos. 2,193,015 and 2,592,364, JP-A- 48-64933, etc. may also be used.

In general, the developing solutions often contain boric acid compounds (for example, boric acid and borax) as pH buffers. However it is preferred that the ascorbic acid-containing developing solutions used in the present invention does not substantially contain boric acid compounds. That is, it is particularly preferred that the amount of the boric acid compounds contained is 0.1 g/l or less.

The processing solutions used in the present invention can be chemically mixed according to the methods described in JP-A-61-177132, JP-A-3-134666 and JP-A-3-67258.

In the processing methods of the present invention, the developing solutions can be replenished by the method described in JP-A-5-216180.

It is more preferred that, when dry-to-dry processing is conducted within 100 seconds, a roller of rubber material as described in JP-A-63-151943 is used as an outlet roller of a developing tank to prevent uneven development inherent in rapid processing, that the extrusion flow rate for stirring the developing solution in the tank is adjusted to 10 m/minute or more as described in JP-A-63-151944, and that the developing solution is stirred more intensively at least during development processing than during standing-by as described in JP-A-63-264758.

In the developing the photographic materials of the present invention, there is no particular limitation on photographic materials.

The present invention will be described in detail below with reference to examples.

EXAMPLE 1

Preparation of Comparative Emulsion A

In a reaction vessel were placed 1,400 ml of an aqueous solution of gelatin having pH 4.5, containing 19.5 g of Gelatin-1 (deionized alkali-treated bone gelatin having a methionine content of about 40 μmol/g) and 6.0 ml of a 1N-solution of $HNO_3$ and 13 ml of an NaCl-1 Solution (containing 10 g of NaCl per 100 ml), and while maintaining the temperature at 40° C., 15.6 ml of an Ag-1 Solution (containing 20 g of $AgNO_3$ per 100 ml) and 15.6 ml of an X-1 Solution (containing 7.05 g of NaCl per 100 ml) were simultaneously added thereto at a rate of 62.4 ml/minute and then mixed. After stirring for 5 minutes, 28.2 ml of an Ag-2 Solution (containing 2 g of $AgNO_3$ per 100 ml) and 28.2 ml of an X-2 Solution (containing 1.4 g of KBr per 100 ml) were simultaneously mixed at a rate of 80.6 ml/minute. After stirring for 3 minutes, 46.8 ml of the Ag-1 Solution and 46.8 ml of the X-1 Solution were simultaneously added thereto at a rate of 62.4 ml/minute and then mixed. After stirring for 2 minutes, 203 ml of an aqueous solution of gelatin (containing 13 g of Gelatin-1, 1.0 g of NaCl, and a 1N-solution of NaOH for adjusting the pH to 6.0) was added thereto to adjust the pCl to 1.45. Then, the temperature was elevated to 75° C. and then ripening was conducted for 12 minutes.

Subsequently, a fine AgCl grain emulsion (average grain diameter: 0.08 μm) and a fine AgBr grain emulsion (average grain diameter: 0.06 μm) each was added at an addition rate of $1.34\times10^{-2}$ mol/min over a 15-minute period. Further, the fine AgCl grain emulison was added at an addition rate of AgCl of $2.68\times10^{-2}$ mol/min over a 5-minute period. After the mixture was subjected to ripening for 10 minutes after addition, a precipitant was added thereto, and the mixture was cooled to 35° C. to wash the precipitates with water. An aqueous solution of gelatin was added to adjust the pH value to 6.0 at 60° C. to prepare Comparative Emulsion A. Replicas of the grains were observed under a transmission electron microscope (hereinafter abbreviated as "TEM"). The resulting emulsion comprised {100} tabular grains having a high content of silver chloride which contain 33.0 mol % of AgBr based on silver. Thus, Comparative Emulsion A was prepared in the manner described above.

One part of the emulsion was sampled and the TEM image (image by a transmission electron microscope) of a replica of the emulsion grain was observed. As a result, it was found that 93% of the projected area of all AgX grains was occupied by tabular grains having a {100} face as the main plane in the form of a right-angled parallelogram with the ratio of adjacent sides being 1.25 on average and an aspect ratio of 2 or more, the circle-corresponding diameter of the projected area of the tabular grain was 1.4 μm on average, the average aspect ratio was 8.1 and the coefficient of variation in the circle-corresponding diameter distribution (standard deviation of the diameter distribution/average diameter) was 0.2.

Preparation of Comparative Emulsion B

Comparative Emulsion B was prepared in the same manner as Comparative Emulsion A except that the growth by adding fine grains after elevation of the temperature to 75° C. was conducted as follows.

The above-described AgCl fine grain emulsion was added at a rate of $2.68\times10^{-2}$ mol/minute over 5 minute-period and then, the AgCl fine grain emulsion and the AgBr fine grain emulsion were added each at a rate of $1.34\times10^{-2}$ mol/minute over 15 minute-period.

Preparation of Comparative Emulsion C

Comparative Emulsion C was prepared in the same manner as Comparative Emulsion A except that the growth by adding fine grains after elevation of the temperature to 75° C. was conducted as follows.

The above-described AgBr fine grain emulsion and the AgCl fine grain emulsion were added simultaneously at a rate of $1.0\times10^{-2}$ mol/minute and $1.68\times10^{-2}$ mol/minute, respectively, over 20-minute period.

Preparation of Emulsions D, E and F of the Present Invention

Emulsions D, E and F of the present invention were prepared in the same manner as Comparative Emulsion A except that the growth was conducted as follows in place of the addition of fine grains after elevation of the temperature to 75° C.

When Ag-3 Solution (containing 50 g of $AgNO_3$ per 100 ml) was added at a rate of $2.68\times10^{-2}$ mol/minute over 20-minute period, X-3 Solution (containing 8.6 g of NaCl per 100 ml) was added by linear flow rate acceleration from 0 to $2.68\times10^{-2}$ mol/minute over 20-minute period and at the same time, X-4 Solution (containing 15.1 g of NaBr per 100 ml) was added by linear flow rate acceleration from $2.68\times10^{-2}$ to 0 mol/minute over 20-minute period.

In this way, Emulsion D of the present invention having an average Br content of 33 mol % was prepared.

Emulsion E was prepared in the same manner as Emulsion D except for exchanging X-3 Solution and X-4 Solution.

Emulsion F was prepared in the same manner as Emulsion D except for replacing X-4 Solution by X-5 Solution (containing 13.9 g of NaBr and 0.5 g of KI per 100 ml).

The thus-prepared Emulsions A to F had a proportion of tabular grains having an aspect ratio of 2 or more and an average aspect ratio of grains occupying 50% or more of the total projected area as shown in Table 1.

TABLE 1

| Emulsion | Proportion of Grains having Aspect Ratio of 2 or More (%) | Average Aspect Ratio | |
|---|---|---|---|
| A | 93 | 8.1 | Comparison |
| B | 95 | 7.9 | Comparison |
| C | 93 | 8.2 | Comparison |
| D | 96 | 8.0 | Invention |
| E | 93 | 7.9 | Invention |
| F | 95 | 8.1 | Invention |

Further, each emulsion was determined on the X-ray diffraction peak from {200} face by Cu(Kβ) beams and the results obtained are shown in Table 2.

TABLE 2

| Emulsion | Number of Diffraction Peak | Half-value Width in Case of Single Peak (times) |
|---|---|---|
| A | 2 | — |
| B | 2 | — |
| C | 1 | 1.05 |
| D | 1 | 1.7 |
| E | 1 | 1.7 |
| F | 1 | 1.80 |

The half-value width is shown as the average of the half-value widths of AgBr and AgCl cubes having a side length of 1 μm and prepared separately.

Emulsion Grains A to F thus-prepared were subjected to chemical sensitization with stirring and maintaining at 60° C. First, $1\times10^{-4}$ mol of Thiosulfonic Acid Compound-I per mol of silver halide was added, and $1\times10^{-6}$ mol of thiourea dioxide per mol of Ag was further added. The mixture was allowed to stand as such for 22 minutes, and subjected to reduction sensitization. Then, $3\times10^{-4}$ mol of 4-hydroxy-6-methyl- 1,3,3a,7-tetraazaindene per mol of Ag, Sensitizing Dye-1 and Sensitizing Dye-2 were each added. Further, calcium chloride was added. Subsequently, sodium thiosulfate ($6\times10^{-6}$ mol per mol of Ag) and Selenium Compound-I ($4\times10^{-6}$ mol per mol of Ag) were added. Furthermore, $1\times10^{-5}$ mol of chloroauric acid per mol of Ag and $3.0\times10^{-3}$ mol of potassium thiocyanate per mol of Ag were added, and after the elapse of 40 minutes, the mixture was cooled to 35° C.

Thus, the preparation of the emulsions (chemical ripening) was terminated.

Thiosulfonic Acid Compound-I $C_2H_5SO_2SNa$

Sensitizing Dye-1

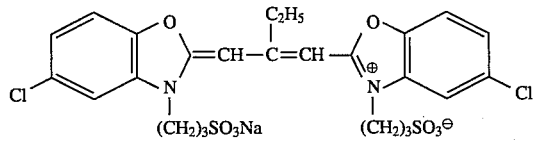

$1\times10^{-3}$ mol per mol of Ag

Sensitizing Dye-2

-continued

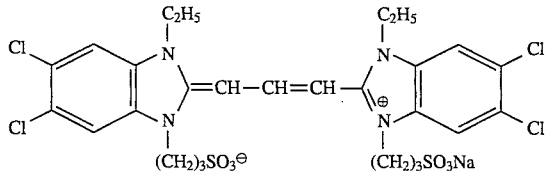

$1 \times 10^{-5}$ mol per mol of Ag

Selenium Compound-I

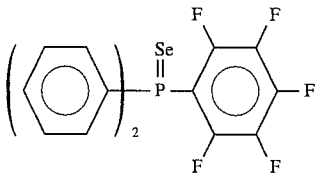

(Preparation of Emulsion Coating Layers)

The following chemicals per mol of silver halide were added to the emulsions subjected to chemical sensitization to prepare emulsion coating solutions.

Gelatin (including also gelatin in the emulsion) 111 g

Dextran (average molecular weight: 39,000) 21.5 g

Polysodium acrylate (average molecular weight: 400,000) 5.1 g

Polysodium styrenesulfonate (average molecular weight: 600,000 ) 1.2 g

Hardener 1,2-bis(vinylsulfonylacetamide)-ethane

The amount to be added was adjusted so that the degree of swelling reached 230%.

Compound-I 42.1 mg

Compound-II 10.3 g

Compound-III 0.11 g

Compound-IV 8.5 mg

Compound-V 0.43 g

Compound-VI 0.004 g

Compound-VII 0.1 g

Compound-VIII 0.1 g

The pH was adjusted to 6.1 with NaOH.

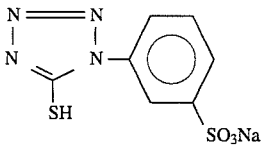

Compound-I

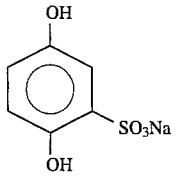

Compound-II

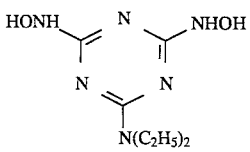

Compound-III

-continued

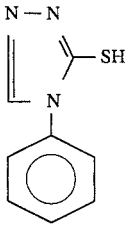

Compound-IV

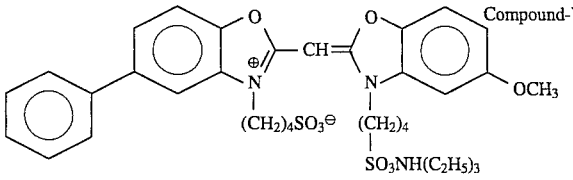

Compound-V

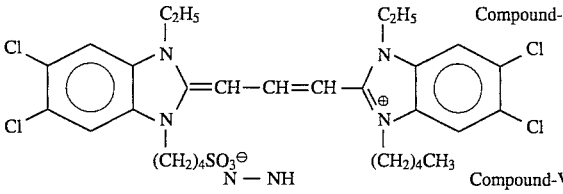

Compound-VI

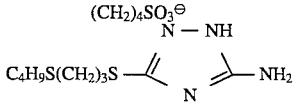

Compound-VII

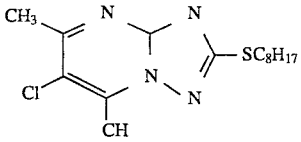

Compound-VIII

Dye Emulsion A was added to the above-mentioned coating solution so as to give an amount of Dye-I of 10 mg/m$^2$ at one side.

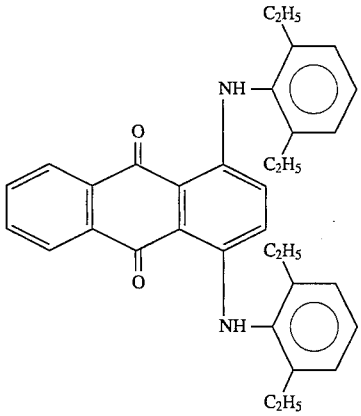

Dye-1

(Preparation of Dye Emulsion A)

Sixty grams of Dye-I described above were dissolved in 62.8 g of the following High-Boiling Organic Solvent-I, 62.8 g of High-Boiling Organic Solvent-II and 333 g of ethyl acetate at 60° C. Then, 65 ml of a 5% aqueous solution of sodium dodecylsulfonate, 94 g of gelatin and 581 ml of water were added thereto, and the mixture was emulsified at 60° C. for 30 minutes using a dissolver. Thereafter, 2 g of the following Compound-VI and 6 liters of water were added, and the mixture was cooled to 40° C. The resulting mixture was concentrated using an Ultrafiltration Labomodule ACP1050 (manufactured by Asahi Chemical Industry) until the whole amount reached 2 kg, and 1 g of Compound-VI described above was added to prepare Dye Emulsion A.

High-Boiling Organic Solvent-I

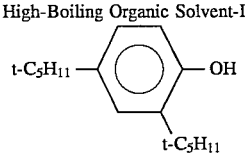

High-Boiling Organic Solvent-II

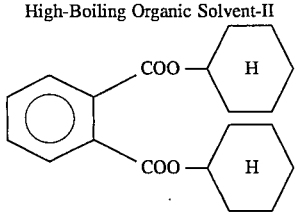

Compound-VI

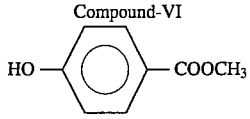

(Preparation of Coating Solution for Surface Protecting Layer)

A coating solution for a surface protecting layer was prepared so as to give the following amount of each component coated.

Gelatin 0.780 g/m$^2$

Polysodium acrylate (average molecular weight: 400,000) 0.035 g/m$^2$

Polysodium styrenesulfonate (average molecular weight: 600,000) 0.0012 g/m$^2$

Polymethyl methacrylate (average particle diameter: 3.7 μm) 0.040 g/m$^2$ (Methylmethacrylate/styrene/methacrylic acid)polymer (average particle diameter: 3.8 μm) 0.040 g/m$^2$ Coating Aid-I 0.020 g/m$^2$ Coating Aid-II 0.037 g/m$^2$ Coating Aid-III 0.0080 g/m$^2$ Coating Aid-IV 0.0032 g/m$^2$ Coating Aid-V 0.0025 g/m$^2$ Coating Aid-VII 0.0022 g/m$^2$ Proxel 0.0010 g/m$^2$ The mixture was adjusted to pH 6.8 with NaOH.

Coating Aid-I

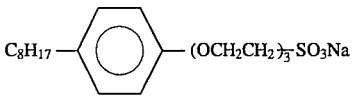

Coating Aid-II $$C_{18}H_{33}O(CH_2CH_2O)_{10}H$$

Coating Aid-III $$C_{17}H_{33}CON(CH_3)CH_2CH_2SO_3Na$$

Coating Aid-IV $$C_8F_{17}SO_2N(C_3H_7)(CH_2CH_2O)_{15}H$$

Coating Aid-V $$C_8F_{17}SO_2N(C_3H_7)(CH_2CH_2O)_4(CH_2)_4SO_3Na$$

-continued

Compound-VII

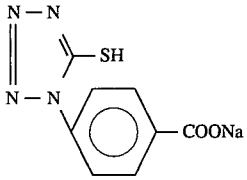

(Preparation of Support)

(1) Preparation of Dye Dispersion B for Undercoating Layer

Dye-II described below was treated with a ball mill according to the method described in JP-A-63-197943.

Dye-II

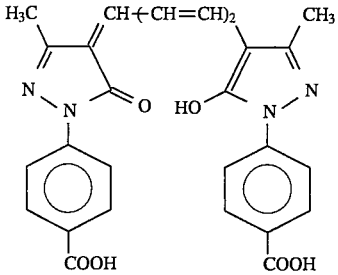

In a 2-liter ball mill were placed 434 ml of water and 791 ml of a 6.7% aqueous solution of Triton X200 (registered trademark), a surfactant [TX-200 (registered trademark)]. Then, 20 g of the dye was added to the solution. To the mixture was added 400 ml of beads (diameter: 2 mm) of zirconium oxide ($ZrO_2$), and the contents were pulverized for 4 days. Thereafter, 160 g of 12.5% gelatin was added. After defoaming, the $ZrO_2$ beads were removed by filtration. A result of observation of the resulting dye dispersion showed that the pulverized dye has a wide particle size distribution of from 0.05 to 1.15 μm and an average particle size of 0.37 μm. In addition, the dye particles having a particle size of 0.9 μm or more were removed by centrifuging, thus obtaining Dye Dispersion B.

(2) Preparation of Support

A biaxially oriented polyethylene terephthalate film having a thickness of 175 μm was subjected to corona discharge, and coated with a first undercoating solution having the following composition with a wire converter so as to give an amount coated of 4.9 ml/m$^2$, followed by drying at 185° C. for 1 minute.

Then, a first undercoating layer was similarly formed also on the opposite surface. Polyethylene terephthalate containing 0.04% by weight of Dye-I was used.

Butadiene-Styrene Copolymer Latex 158 ml Solution (solid content: 40%, weight ratio of butadiene/styrene= 31/69)

4% Solution of Sodium Salt of 2,4-Dichloro- 6-hydroxy-s-triazine 41 ml

Distilled Water 801 ml

*The latex solution contains 0.4% by weight of the following compound as an emulsification dispersing agent, based on the latex solid content.

Emulsification Dispersing Agent Containing

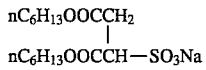

in an amount of 0.4% by weight based on the solid content of latex (3) Coating of Undercoating Layers The second undercoating layers having the following composition were coated on the above-described first undercoating layers on the both surfaces, respectively, using a wire bar coater system, so as to provide the amounts coated described below, and dried at 155° C.

Gelatin 80 mg/m$^2$

Dye Dispersion B (as solid dye) 8 mg/m$^2$

Coating Aid-VI 1.8 mg/m$^2$

Compound-VIII 0.27 mg/m$^2$

Matting Agent (Polymethyl methacrylate having an average particle diameter of 2.5 μm) 2.5 mg/m$^2$ Coating Aid-VI $C_{12}H_{25}O(CH_2CH_2O)_{10}H$

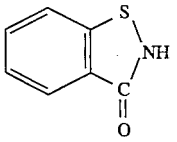

Compound-VIII (Preparation of Photographic Materials)

The thus-prepared support was coated on the both surfaces with a combination of the above-described emulsion layer and surface-protecting layer by the extrusion technique to prepare Photographic Materials 1 to 6. The weight of silver coated per one surface was 1.75 g/m$^2$.

(Evaluation of Photographic Performance)

The photographic materials were exposed for a period of 0.05 second from the both sides using a X-ray Orthoscreen HR-4 (manufactured by, Fuji Photo Film Co., Ltd.). After exposure, the sensitivity was evaluated using the following automatic processing machine and processing solutions. The sensitivity was shown as the logarithm of the reciprocal of an exposure amount required to give the density of fog+0.1, and was here represented by relative values to the sensitivity of Emulsion C which was taken as 100.

(Processing)

Automatic processing machine (APM): CEPROS-M (manufactured by Fuji Photo Film Co., Ltd.) was converted to incorporate a heat roller into a drying zone and the conveying speed was accelerated up to 30 seconds in dry-to-dry processing.

Preparation of Concentrated Solution:

(Developing Solution)

Part Agent A:

Potassium Hydroxide 330 g

Potassium Sulfide 630 g

Sodium Sulfite 255 g

Potassium Carbonate 90 g

Boric Acid 45 g

Diethylene Glycol 180 g

Diethylenetriamine Pentaacetate 30 g 1-(N,N-Diethylamino)ethyl-5-mercaptotetrazole 0.75 g Hydroquinone 450 g 4-Hydroxymethyl-4-methyl-1-phenyl-3-pyrazolidone 60 g Water to make 4,125 ml Part Agent B:

Diethylene Glycol 525 g 3,3'-Dithiobishydrocinnamic Acid 3 g

Glacial Acetic Acid 102.6 g

2-Nitroindazole 3.75 g

1-Phenyl-3-pyrazolidone 34.5 g

Water to make 750 ml

Part Agent C:

Glutaraldehyde (50 wt/wt %) 150 g

Potassium Bromide 15 g

Potassium Metabisulfite 105 g

Water to make 750 ml (Fixing Solution)

Ammonium Thiosulfate (70 wt/vol %) 3,000 ml

Disodium Ethylenediaminetetraacetate 0.45 g Dihydrate

Sodium Sulfite 225 g

Boric Acid 60 g 1-(N,N-Diethylamine)ethyl-5-mercaptotetrazole 15 g

Tartaric Acid 48 g

Glacial Acetic Acid 675 g

Sodium Hydroxide 225 g

Sulfuric Acid (36N) 58.5 g

Aluminum Sulfate 150 g

Water to make 6,000 ml pH 4.68

(Preparation of Processing Solutions)

The following vessel was filled with the respective part agents of the above-described concentrated developing solution. The vessel has respective sectional vessels for Part Agents A, B and C which are linked to one another.

A similar vessel was filled with the above-described concentrated fixing solution.

First, 300 ml of an aqueous solution containing 54 g of acetic acid and 55.5 g of potassium bromide was added as a starter to a developing tank.

The vessel filled with the above-described processing agents was turned upside down and pushed in a boring blade of a stock tank for processing solution mounted on the side of the APM to break a sealing film on a cap, and the stock tank was filled with the respective processing agents in the vessel.

A developing tank and a fixing tank of the APM were filled with the respective processing agents by operation of respective pumps mounted thereto in the following ratios.

Every time the 8 photographic materials converted to 25.4 cm×30.5 cm were processed, stock solutions of the respective processing agents were mixed with water in these ratios, and replenished to the processing tanks of the APM.

Developing solution:

Part Solution A 51 ml

Part Solution B 10 ml

Part Solution C 10 ml

Water 125 ml pH 10.50

Fixing Solution:

Concentrated Solution 80 ml

Water 120 ml pH 4.62

The washing tank was filled with city water.

Three bottles formed of polyethylene each was filled with 0.4 g of pearlite with an average particle diameter of 100 μm and an average pore diameter of 3 μm on which Actinomycetes were supported as a scale inhibitor (the opening of each bottle was covered with a 300-mesh nylon cloth so that water and the fungi pass through the cloth). Two bottles of them were placed on the bottom of the washing tank and the other bottle was placed on the bottom of the stock tank (the liquid volume: 0.2 liter).

Processing Speed and Processing Temperature:

| | | |
|---|---|---|
| Development | 35° C. | 8.8 seconds |
| Fixing | 32° C. | 7.7 seconds |
| Washing | 17° C. | 3.8 seconds |
| Squeeze | | 4.4 seconds |
| Drying | 58° C. | 5.3 seconds |
| Total | | 30 seconds |

Amount of Replenisher

Developing Solution 25 ml/10×12 inches

Fixing Solution 25 ml/10×12 inches

The results are shown in Table 3.

TABLE 3

| Sample | Emulsion | Sensitivity | Fog |
|---|---|---|---|
| 1 | A | 80 | 0.06 |
| 2 | B | 105 | 0.05 |
| 3 | C | 100 | 0.06 |
| 4 | D | 160 | 0.03 |
| 5 | E | 135 | 0.04 |
| 6 | F | 120 | 0.04 |

As is apparent from the results of Table 3, the photographic material of the present invention can obtain high sensitivity and low fogging property even if the rapid processing is carried out.

EXAMPLE 2

Evaluation of Pressure Durability

Each of the photographic materials prepared in Example 1 was subjected to humidity conditioning under the conditions of 25° C. and 25% RH for 1 hour and then bent at 180° to agree with the stainless steel pipe having a diameter of 6 mm under the same conditions. The bending speed was such that 180°-bending was done within 1 second and the original shape was recovered within next 1 second. Each of the photographic materials was processed 30 seconds after the bending in the same manner as in the evaluation of photographic performance.

Thereafter, increase in the density (exclusive of the fog and the base density inherent in the emulsion) on the belt-like blackened portion along the stainless steel pipe was visually evaluated. The results obtained are shown in Table 4.

TABLE 4

| Sample | Pressure Durability |
|---|---|
| 1 | F |
| 2 | F |
| 3 | B |
| 4 | E |
| 5 | G |
| 6 | G |

E: low blackening density with no desensitization
G: relatively low blackening density with little desensitization
F: blackening and desensitization on the tolerance limits in practical use
B: extreme blackening or desensitization As is clearly seen from the results of Table 1, the photographic materials of the present invention exhibited excellent pressure performance.

EXAMPLE 3

Each of the photographic materials prepared in Example 2 was processed, without subjecting it to exposure, in the same manner as in Example 1 in an automatic developing machine and the residual Ag amount and the residual hypo amount in the photographic material were measured. The results obtained are shown in Table 5.

TABLE 5

| Photographic Material | Residual Silver Amount | Residual Hypo Amount |
|---|---|---|
| 1 | 90 | 100 |
| 2 | 105 | 95 |
| 3 | 100 | 100 |
| 4 | 60 | 55 |
| 5 | 80 | 70 |
| 6 | 75 | 75 |

In Table 5, the results are shown by a relative value to the residual silver amount or the residual hypo amount of Photographic Material 3 taken as 100.

As is apparent from the results of Table 5, the photographic materials of the present invention showed excellent fixing and water washing properties.

EXAMPLE 4

The photographic materials prepared in Example 1 were treated with the following developing solution.

[Processing with Automatic Processing Machine]

An automatic processing machine (APM) ("Fuji X-Ray Processor CEPROS-M" manufactured by Fuji Photo and Film Co., Ltd.) was converted in a drive shaft so that the whole processing time became 30 seconds. The drying blow-off temperature was set at 55° C.

Formulation of Developing Solution:

Part A:

Potassium Hydroxide 18.0 g

Potassium Sulfite 30.0 g

Sodium Carbonate 30.0 g

Diethylene Glycol 10.0 g

Diethyltriamine Pentaacetate 2.0 g 1-(N,N-Diethylamino)ethyl-5-mercaptotetrazole 0.1 g L-Ascorbic Acid 43.2 g 4-Hydroxymethyl-4-methyl-1-phenyl-3-pyrazolidone 2.0g Water to make 300 ml Part B:

Triethylene Glycol 45.0 g 3,3'-Dithiobishydrocinnamic Acid 0.2 g

Glacial Acetic Acid 5.0 g

5-Nitroindazole 0.3 g

1-Phenyl-3-pyrazolidone 3.5 g

Water to make 60 ml

Part C:

Glutaraldehyde (50%) 10.0 g

Potassium Bromide 4.0 g

Potassium metabisulfite 10.0 g

Water to make 50 ml

A mixture of 300 ml of Part A, 60 ml of Part B and 50 ml of Part C was made up to 1 liter with water, and adjusted to pH 10.90.

A CE-DF1 bottle (manufactured by Fuji Photo Film Co., Ltd.) was filled with 4.50 liters of Part A, 0.90 liter of Part B and 0.75 liter of Part C and used for a 1.5-liter working solution.

Development Starting Solution:

A solution obtained by adding acetic acid to the above-mentioned developing replenisher to adjust the pH to 10.20 was used as a development starting solution.

As a fixing solution was used CE-F1 (:manufactured by Fuji Photo Film Co., Ltd.).

Developing Temperature 35° C.

Fixing Temperature 35° C.

Drying Temperature 55° C.

For each sample, 600 film sheets having a size of 10×12 inches were subjected to running processing at a replenishment rate of 25 ml/10×21 inches (325 ml/$m^2$) (both the developing solution and the fixing solution). That is, the replenishment rate for the 600 film sheets is (25 ml×600 sheets) ml. As a result, satisfactory results were obtained.

When the photographic materials of the present invention are combined with the (ascorbic acid) developing solution, the sensitivity of the running solution satisfactorily remained unchanged from the beginning.

EXAMPLE 6

Each of the photographic materials prepared in Example 1 was subjected to image formation by the X-ray exposure using a fluorescent screen described in JP-A-6-11804 and as a result, it was confirmed that a good X-ray image was formed.

The ultravision fast detail (UV) manufactured by Du Pont was used and put into close contact with both sides of the photographic material and an exposure light was applied from both sides for 0.05 second to conduct X-ray sensitometry.

The exposure amount was controlled by changing the distance between the X-ray tube ball and the cassette. After the exposure, the photographic material was processed with the same developer and the same fixing solution as in Example 1 in an automatic developing machine and it was confirmed that a good X-ray image was formed.

While the invention has been described in detail and with reference to specific embodiments thereof, it will be apparent to one skilled in the art that various changes and modifications can be made therein without departing from the spirit and scope thereof.

What is claimed is:

1. A silver halide emulsion in which at least 50% of the total projected area of silver halide grains comprises tabular core/shell grains each having a {100} face as a main plane and said silver halide grains substantially comprise silver chlorobromide with the halogen composition continuously being varied in the shell part.

2. The silver halide emulsion as claimed in claim 1, wherein at least 50% of the total projected area of silver halide grains is occupied by tabular grains having an aspect ratio of 2 or more and a silver chloride content of 20 mol % or more.

3. The silver halide emulsion as claimed in claim 1, wherein a layer having a highest silver bromide content is provided in an inner region beneath a the final grain growth layer which final grain growth layer represents the outer 10% by volume of the grain.

4. The silver halide emulsion as claimed in claim 1, which is subjected to chemical sensitization by a selenium sensitizer and a gold sensitizer.

5. The silver halide emulsion as claimed in claim 4, wherein the chemical sensitization is carried out in the presence of a silver halide solvent.

6. The silver halide emulsion as claimed in claim 1, which is subjected to spectral sensitization by a dye having an absorption maximum between 530 nm and 570 nm in such a state that the dye is adsorbed to the silver halide grain.

7. A silver halide photographic material comprising a support having on both side surfaces thereof an emulsion layer containing at least one silver halide emulsion in which at least 50% of the total projected area of silver halide grains comprises tabular core/shell grains each having a {100} face as a main plane and said silver halide grain substantially comprise silver chlorobromide with the halogen composition continuously being varied in the shell part.

8. The silver halide photographic material as claimed in claim 7, further comprising an emission fluorescent material which emits light on exposure to an X ray having an emission peak at 400 nm or less.

* * * * *